US005367462A

United States Patent [19]

Klenk et al.

[11] Patent Number: 5,367,462

[45] Date of Patent: Nov. 22, 1994

[54] PROCESS FOR DETERMINING FUEL QUANTITY

[75] Inventors: Martin Klenk, Backnang; Winfried Moser, Ludwigsburg; Kurt Ingrisch, Reutlingen; Christian Klinke, Pleidelsheim, all of Germany

[73] Assignee: Robert Bosch GmbH, Stuttgart, Germany

[21] Appl. No.: 167,582

[22] Filed: Dec. 14, 1993

Related U.S. Application Data

[63] Continuation of Ser. No. 688,622, Jun. 13, 1991, abandoned.

[30] Foreign Application Priority Data

Dec. 14, 1988 [DE] Germany ..... 3842075

[51] Int. Cl.[5] ..... F02M 51/00

[52] U.S. Cl. ..... 364/431.05; 364/431.04; 123/478; 123/488; 123/480; 123/493

[58] Field of Search ..... 123/478, 480, 488, 490, 123/491, 492, 493; 364/431.04, 431.05, 431.01–431.12

[56] References Cited

U.S. PATENT DOCUMENTS

| | | | |
|---|---|---|---|
| 4,086,884 | 5/1978 | Moon et al. | 123/32 EB |
| 4,373,501 | 2/1983 | Rado | 123/589 |
| 4,497,301 | 2/1985 | Inoue et al. | 123/486 |
| 4,501,249 | 2/1985 | Amano et al. | 123/478 |
| 4,667,640 | 5/1987 | Sekozawa et al. | 123/492 |
| 4,698,765 | 10/1987 | Abe et al. | 364/431.04 |
| 4,886,030 | 12/1989 | Oba et al. | 123/488 |
| 4,903,649 | 2/1990 | Staerzl | 123/73 A |
| 4,971,009 | 11/1990 | Washino et al. | 123/435 |
| 4,974,563 | 12/1990 | Ikeda et al. | 123/480 |
| 5,003,950 | 4/1991 | Kato et al. | 123/488 |
| 5,067,460 | 11/1991 | Van Duyne | 123/337 |
| 5,107,815 | 4/1992 | Van Duyne | 123/435 |

FOREIGN PATENT DOCUMENTS

| | | |
|---|---|---|
| 152019 | 8/1985 | European Pat. Off. . |
| 259544 | 3/1988 | European Pat. Off. . |
| 301548 | 2/1989 | European Pat. Off. . |
| 326065 | 8/1989 | European Pat. Off. . |
| 3721911 | 1/1988 | Germany . |
| 2190202 | 11/1987 | United Kingdom . |

*Primary Examiner*—Thomas G. Black
*Assistant Examiner*—Jacques Harold Louis-Jacques
*Attorney, Agent, or Firm*—Kenyon & Kenyon

[57] ABSTRACT

In order to determine the fuel quantity to be fed into an internal combustion engine during each stroke of the engine, the air mass sucked into each cylinder for combustion during each intake stroke is determined based on an intake-pipe pressure. A current air mass is determined using a measured value for the intake-pipe pressure. Subsequently, during a period in which there is no change in an air intake cross-section for each cylinder, the air mass is determined using a projected intake-pipe pressure, and the fuel quantity to be fed to each cylinder during the current and subsequent intake strokes is determined based on the air mass determinations and a wall film model.

12 Claims, 4 Drawing Sheets

FIG. 9
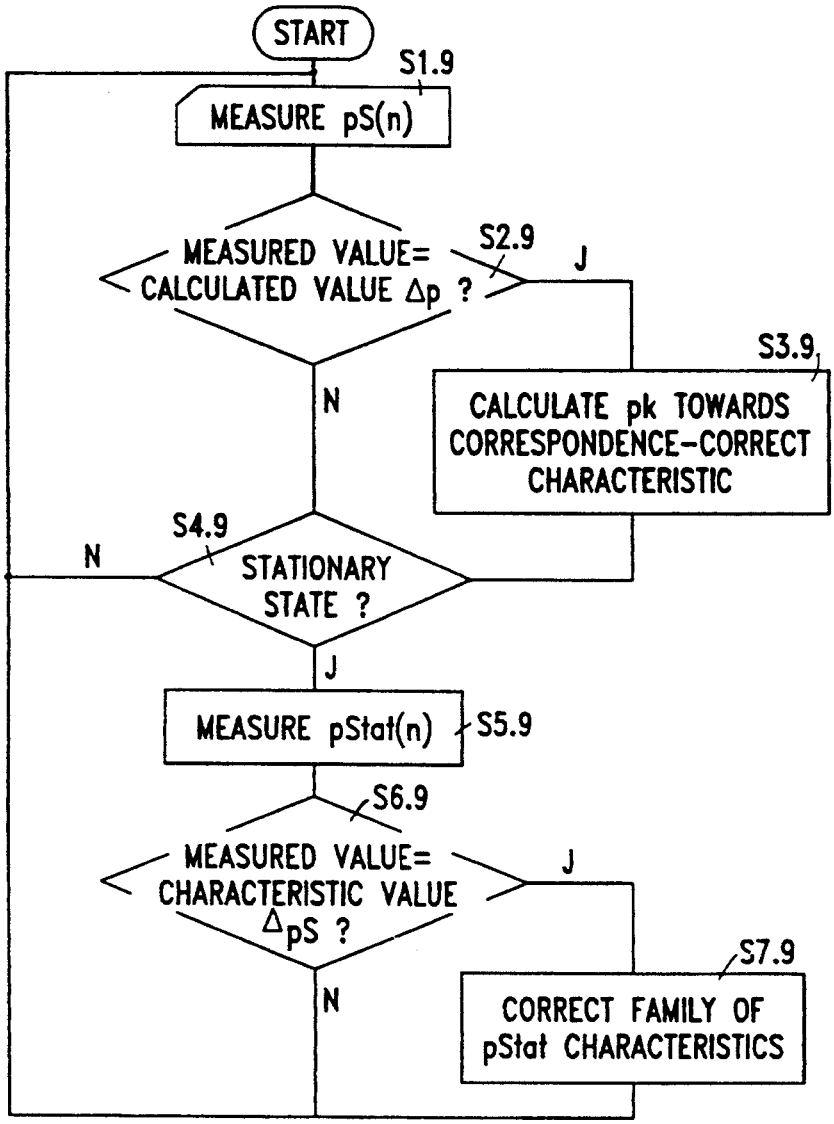
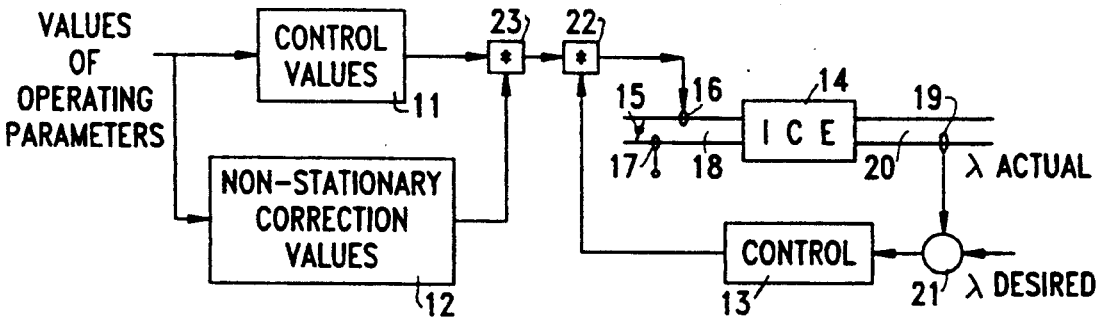
FIG. 11
STATE OF THE ART

PROCESS FOR DETERMINING FUEL QUANTITY

This is a continuation of application Ser. No. 07/688,622, filed on Jun. 13, 1991, now abandoned.

FIELD OF THE INVENTION

The invention relates to a process for determining the fuel quantity to be fed to an internal-combustion engine during each stroke.

BACKGROUND OF THE INVENTION

Processes known from the state of the art are described hereafter with reference to the known arrangement illustrated in FIG. 11. This arrangement has a means 11 for determining the control values, a means 12 for determining non-stationary transition values, a regulating means 13 and an internal-combustion engine 14 with a throttle flap 15, injection-valve arrangement 16 and pressure sensor 17 in the intake pipe 18 and with a lambda probe 19 in the exhaust pipe 20. It will initially be assumed that the internal-combustion engine 14 is being operated in a controlled manner. In this case, only the signal from the means 11 for determining the control values acts on the injection-valve arrangement 16. Values of operating parameters, especially the set angle of the throttle flap 15 and the engine speed, are fed to the means 11 for determining the control values, whereupon the means 11 emits an injection-time signal. It is also possible for only the pressure signal from the intake-pipe pressure sensor 17 to be fed as an input signal to the means 11 for determining the control values. The injection time is then set essentially in proportion to the measured pressure. For the full-clad range, the signal is advantageously also corrected by means of values which are read out from a family of characteristics as a function of values of operating parameters.

Simply controlling the-injection time is often insufficient for achieving a desired exhaust-gas quality. This can be improved with the aid of the lambda probe 19 and the regulating means 13. For this purpose, the lambda actual value from the lambda probe 19 is compared with a lambda desired value in a comparator stage 21, and the difference value is fed as a control deviation to the regulating means 13 which, as a function of the control deviation, determines a set value in the form of a regulating factor RF which, in a set-value logic stage 22, is multiplied by the value emitted by the means 11 for determining the control values. The control circuit described guarantees that control values by which the desired lambda value cannot be obtained alone are corrected in such a way that this object is nevertheless achieved.

Irrespective of whether the fuel quantity to be injected is merely controlled or whether there is a pilot control with superposed regulation, it must be remembered that the values emitted by the means 11 for determining the control values are normally determined for stationary operating states. However, if, for example, acceleration takes place between a first stationary operating state and a secondary stationary operating state, an acceleration enrichment is required in the meantime. So that this non-stationary situation according to the example or even other non-stationary situations can be dealt with, the means 12 for determining non-stationary transition values is provided. If values of operating parameters change with a high time gradient, the means 12 for determining non-stationary transition values emits a time sequence of values which are logically linked to control values in a non-stationary correction stage 23.

The non-stationary correction can be present on controlled systems or on pilot-controlled systems with superposed regulation. In all the practical applications, particular problems arise in those situations in which plurality of non-stationary conditions respectively initiating new non-stationary transition functions are satisfied in a short time sequence. This often leads, practice, to overlaps which reinforce or cancel one another in an undesirable way.

To prevent overlaps of this type, attempts are made to determine the control values permanently by the same process, that is to say not to differentiate between stationary or non-stationary operating states. Such a process is described in: 'Non-stationary behavior—a factor in engine tuning' by M. Theissen, H.-St. Braun and G. Kramer in Conference Volume 1 Aachener Conference, Vehicle and Engine Technology '87, Aachen October 1987. The errors occurring in the determination of control values in non-stationary processes when no special measures are taken are designated as updating errors, phase errors and wall-film errors.

The updating error is dealt with in a conventional way, namely in that, when a non-stationary event has occurred after the calculation of the fuel quantity to be fed during the next stroke and the new fuel quantity taking this event into account can be taken into account before the conclusion of the intake stroke, an after-injection takes place.

The wall-film error is calculated individually as a function of the values of various operating parameters.

The phase error is an error which originates particularly from the fact that an air-quantity meter measures not only the air sucked in for combustion, but also the air serving for increasing the pressure in the intake pipe. This phase error is compensated by adapting the slope of the signal from the air-quantity meter to the slope of the intake-pipe pressure. The intake-pipe pressure is therefore measured, and the air mass sucked in for combustion during each stroke is determined by means of the intake-pipe pressure.

Because the phase error is adjusted by adapting the slope of the signal from the air-mass meter to the slope of the signal from the pressure sensor, in a non-stationary situation this process behaves in a similar way to those standard processes in which the air mass sucked in for combustion is determined directly from the measured intake-pipe pressure. However, it is a known fact in these processes that they do not compensate in a fully satisfactory way for the phase error which occurs during a non-stationary process.

The object on which the invention is based is to provide a process for determining the fuel quantity to be fed to an internal-combustion engine during each stroke, by means of which phase errors can largely be prevented.

SUMMARY OF THE INVENTION

The present invention is directed to a process for determining the fuel quantity to be fed to an internal-combustion engine during each intake stroke comprising the steps of determining, for each cylinder, the air mass sucked therein for combustion during each intake stroke based on an intake-pipe pressure, with a current air mass being determined using a measured value for the intake-pipe pressure and subsequently, during a period in which there is no change in an air intake cross-section for each cylinder, determining the air mass using a projected intake-pipe pressure, and determining the fuel quantity to be fed to each cylinder during the current and subsequent intake strokes based on the air mass determinations and a wall film model. The two processes according to the invention can be used either separately or preferably together with one another. A process according to the invention also makes possible the additional correction of the ignition time.

The process according to the present invention is characterized in that the air mass sucked in for combustion is no longer determined from the currently measured intake-pipe pressure, but instead a determination is made as to the intake-pipe pressure will probably occur during the next stroke. The air-mass calculation is carried out by means of this previously calculated intake-pipe pressure. This procedure makes use of the fact that, during non-stationary transitions, the intake-pipe pressure changes relatively sharply from stroke to stroke. That is to say, considerably better control values for the fuel quantity to be fed during the next stroke can be obtained when the intake-pipe pressure probably prevailing then is already being taken into account.

A process according to one embodiment of the invention is characterized in that the air mass determined by means of the intake-pipe pressure is also corrected by means of a value which takes temperature influences particularly into account. It has been shown that the air mass sucked in for combustion does not correspond to that mass which would actually be expected in view of the pressure conditions. It must be remembered, here, that pressure conditions actually influence the flow of an air volume, but not a mass. The air mass present in a specific volume also depends on the temperature of the air sucked in. However, the temperature conditions in an internal-combustion engine change during non-stationary transitions. The relation between the correction value and the values of operating parameters can be predetermined. This predetermined relation is then used for correcting the air mass which was first determined by means of the intake-pipe pressure.

To determine the intake-pipe pressure during the following stroke according to the process of a further embodiment of the invention, various alternatives are specified, which are each especially advantageous depending on their various aspects.

So that a future intake-pipe pressure can be calculated, it has to be assumed that the intake-pipe pressure changes in time according to a specific function. In the simplest case, a linear change is assumed, but it has been shown that very small deviations between calculated and measured values occur when a transition of the first, order is postulated for the change. One such as this has four parameters. These can be determined, for example, by measuring the time of occurrence of a fault and the intake-pipe pressure for three successive cycles, including the current cycle, storing the values and then calculating the current values of the parameters from the four measurement results. By means of the transition function thus known, the intake-pipe pressure probably prevailing during the next stroke can be determined. This process is characterized in that it always works with current values, that is to say, without families of characteristics. Thus, high accuracy results when, after a change of the flow cross-sections, especially by change of the set angle of a throttle flap, no further changes of this kind take place. However, if the cross-section changes continuously, the parameters of the transition function also change continuously. However, this is not sufficiently taken into account because obsolete values are used for the calculation.

In the latter case, processes of greater accuracy are those which always determine the intake-pipe pressure probably prevailing during the next stroke on the basis of the current intake cross-section, the current speed and the current intake-pipe pressure only. This update is possible when the start of each computing cycle is set as the start of the transition function and when families of characteristics are used, specifically one for the final value of the transition function and one for the time constant of the transition function. The last parameter is fixed by determining the current intake-pipe pressure. This determination can be carried out either by measuring the intake-pipe pressure or by using, in a recurrence formula, as the current intake-pipe pressure that intake-pipe pressure which was calculated in the previous cycle as the next following pressure. The advantage of the first alternative is that the current intake-pipe pressure is always reliably at the correct value, with the disadvantage however that a pressure sensor, that is to say a relatively expensive component, is required. The advantage of the second alternative is that there is no need for a pressure sensor, but the pressure calculated from the recurrence formula may deviate slightly from the actual pressure.

When the intake-pipe pressure is measured, according to yet another embodiment of the invention the adaptation of the values in the said families of characteristics is possible. A measurement of the mass air flow makes a further adaptation possible.

It is preeminently advantageous to determine, by means of the previously calculated air mass, not only the fuel quantity to be fed, but also the ignition time.

BRIEF DESCRIPTION OF THE DRAWINGS

The invention is explained in detail below by means of exemplary embodiments illustrated by figures. Of these:

FIG. 9 shows a flow diagram for explaining an adaptation process; and

FIG. 11 illustrates a known arrangement for determining fuel quantity.

DETAILED DESCRIPTION

Figure 10:
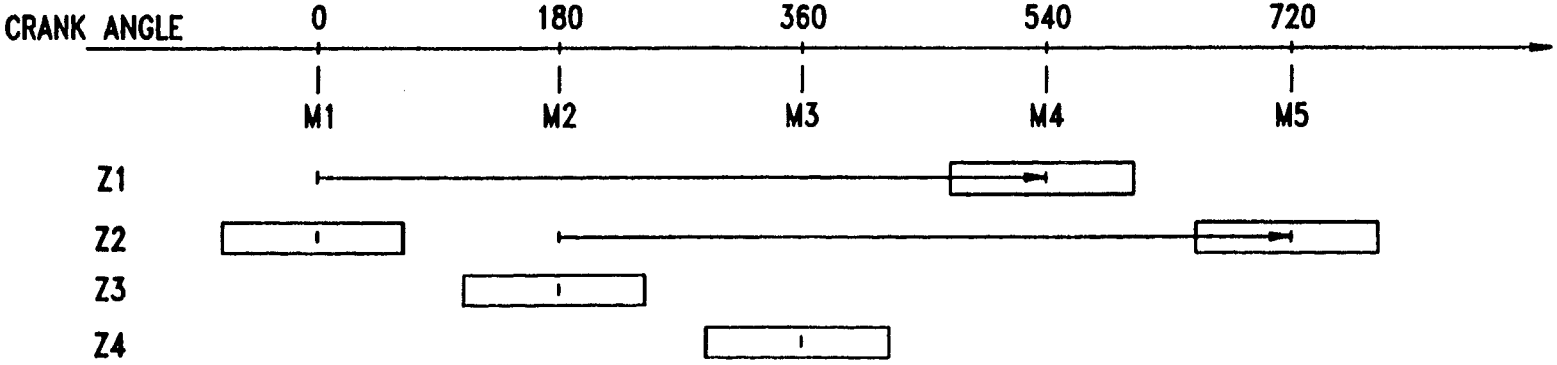
FIG. 10 shows a diagram to explain the time relation between intake strokes and computing cycles.

The following description assumes that, to adjust the flow cross-section for air sucked in, there is a throttle flap corresponding to the throttle flap in FIG. 10. The throttle-flap angle is therefore always mentioned instead of the flow cross-section. If another device, for example a slide or a lamellar arrangement, is used instead of a throttle flap for adjusting the cross-section, a displacement travel or a lamella angle must replace the throttle-flap angle accordingly. It is also always assumed hereafter that the fuel feed is carried out by means of an injection-valve arrangement. However, it is also possible to use another fuel-proportioning device, for example a carburetor, which is always set so that, in terms of an intake stroke, a specific fuel quantity is added to the air mass sucked in. Finally, it is pointed out that it is unimportant whether the values calculated according to the processes described below are used only for controlling the fuel mass or for a pilot control with superposed regulation.

The preferred exemplary embodiment is now discussed in general by means of FIGS. 1 to 5.

Figure 1:
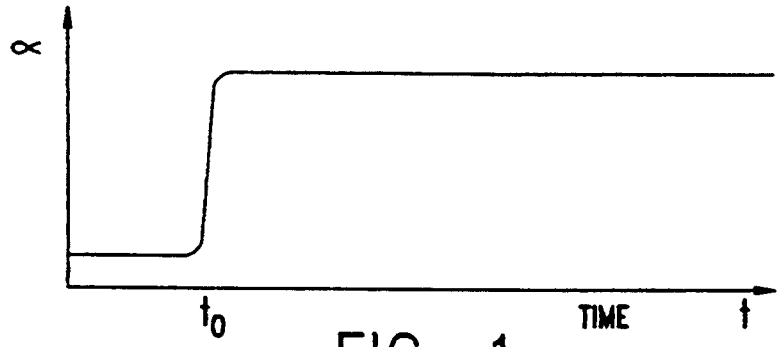
FIGS. 1–4 show time-correlated diagrams relating to the change in the set angle of a throttle flap, the associated change in the intake-pipe pressure, an associated temperature-dependent air-mass change and a wall-film fuel-mass change.

In FIG. 1, the throttle-flap angle is plotted against the time t. At a time $t_0$ the throttle-flap angle changes abruptly from an old stationary value to a new stationary value corresponding to a larger orifice cross-section than there was before.

As a result of the increased orifice cross-section, the intake-pipe pressure rises according to the change in the throttle-flap angle, specifically essentially according to a transition function of the first order, that is to say according to the formula $$Ps(t)=Ps(T_0)+(Pstat(t_0)-Ps(t_0)\ (1-e^{-(t-t0)/kp})) \quad (1)$$

Figure 2:
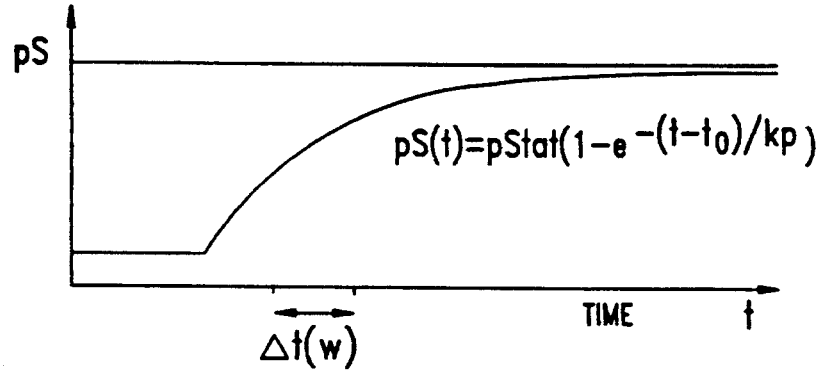

This time change in the intake-pipe pressure Ps(t) is plotted in FIG. 2. By means of this, it is possible to predict what value the intake-pipe pressure will assume at a time which is later by the time interval $\Delta t(\omega)$ than the present time. This time interval is likewise plotted in FIG. 2. It must be remembered, in the following, that during the actual calculation of the intake-pipe pressure there must be a prediction not over a specific time interval, but over a specific crank-angle interval. The predicted time interval is therefore dependent on the speed $\omega$. For the sake of simplicity, it will first be assumed that the predicted time interval corresponds to a permanently fixed crank-angle interval of 720°, that is to say to the spacing between two intake strokes for a particular fixed cylinder. The number of computing cycles for a particular cylinder is then identical to the number of intake strokes for this cylinder. The particular current computing cycle is designated hereafter by the letter n.

Figure 5:
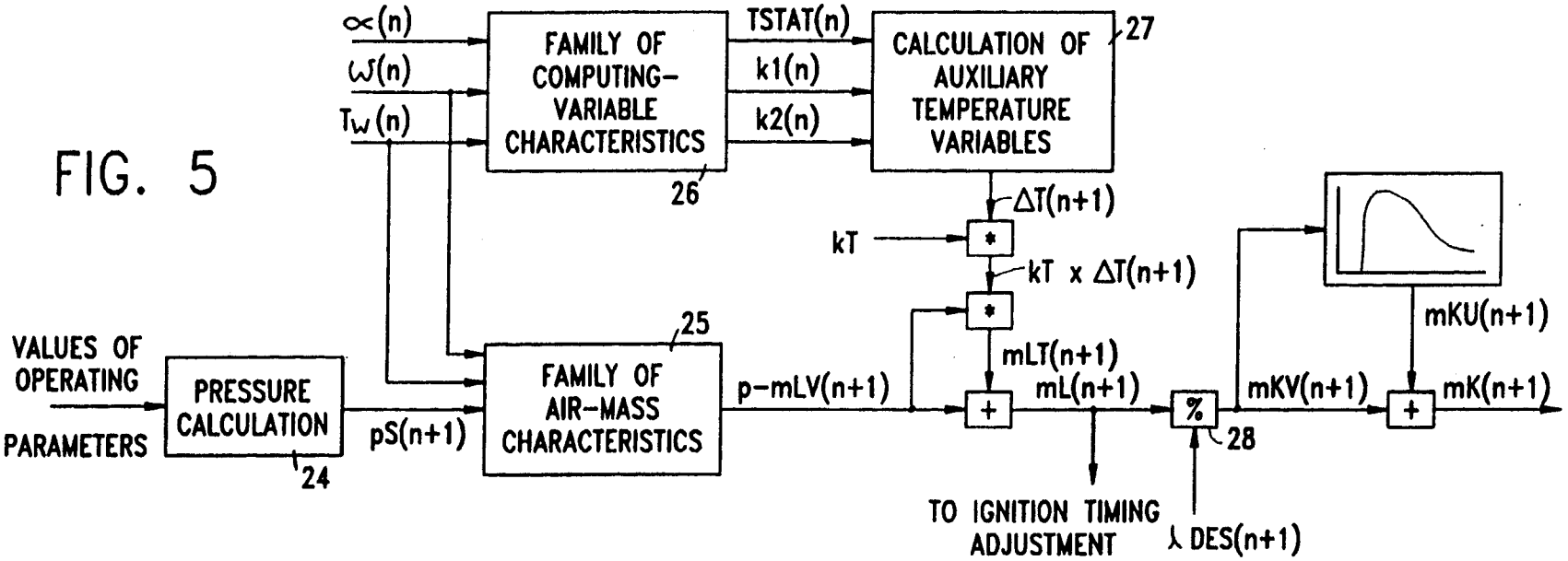
FIG. 5 shows a representation of a preferred process flow in the form of a block diagram.

According to FIG. 5, the intake-pipe pressure is calculated in a means 24 for pressure calculation. During the current computing cycle n, the pressure Ps(n+1) probably prevailing during the next intake stroke for the one particular cylinder under consideration is calculated. Examples for the calculation are explained further below with reference to FIGS. 6–8.

It can also be seen from FIG. 5 that a provisional air mass MLV(n+1), such as will probably be sucked in during the next intake stroke, is calculated from the intake-pipe pressure Ps(n+1) for the next stroke. It is known that, with the exception of the full-load range, this mass is essentially proportional to the intake-pipe pressure. In the exemplary embodiment, the provisional air mass MLV(n+1) is read out from a family of air-mass characteristics 25, specifically addressed via values of the calculated intake-pipe pressure Ps(n+1), the speed $\omega$ and the engine temperature $t_w$.

Figure 3:
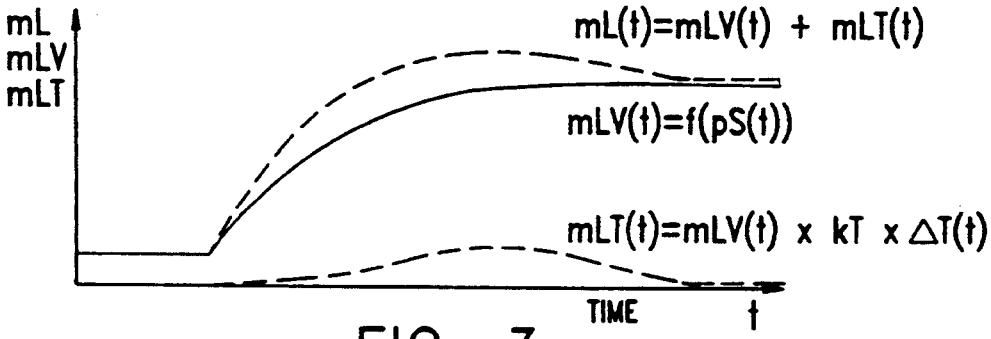

The time trend of the provisionally calculated air mass MLV(t) as a function of the intake-pipe pressure Ps(t) is represented in FIG. 3. In FIG. 3, a further air mass is plotted, specifically a temperature-dependent air mass MLT(t) which is to be added to the provisional air mass in order to obtain the air mass M1(t) actually sucked in for combustion. The temperature-dependent air mass MLT(t) is calculated by means of an auxiliary temperature variable $\Delta T(t)$. For this, according to FIG. 5, auxiliary variables Tstat(n), $h_1(n)$ and $h_2(n)$ are read out from a family of auxiliary-temperature-variable characteristics 26, addressable via values of the throttle-flap angle, the speed and the engine temperature for the computing cycle n. The values read out are converted by a means 27 for recurrence calculation into a future value $\Delta T(n+1)$, and this is multiplied by a constant Kt and the provisional air mass MLV(n+1), and the temperature-dependent air mass MLT(n+1) thus obtained is added to the provisional air mass MLV(n+1).

From the thus determined air mass M1(n+1) sucked in from the intake pipe, it is possible to calculate the fuel mass which is to be added to the air mass in order to obtain a specific lambda value. According to FIG. 5, this conversion takes place in a divider stage 28. However, the fuel mass so calculated is not exactly that which is to be added to the air mass sucked in, since some fuel is also to be used additionally for the buildup of a wall film or is freed from the wall film if, in contrast to FIG. 1, a deceleration is initiated instead of an acceleration. The fuel mass calculated from the air mass sucked in M1(n+1) is therefore only a provisional fuel mass MKV(n+1).

Figure 4:
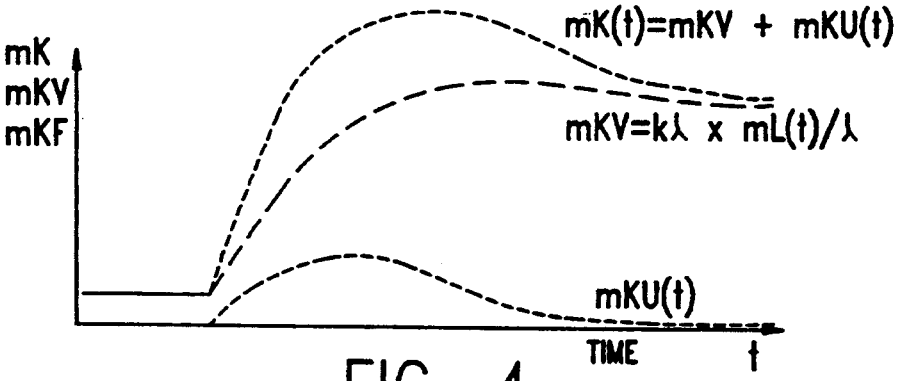

The time trend of this provisional fuel mass MKV(t) is plotted in FIG. 4. The fuel mass MkÜ(t) to be injected additionally for the build-up of the wall film is also plotted there. The actual fuel mass to be injected Mk(t) is the sum of the provisional fuel mass and the fuel mass necessary for the build-up of the wall film. This summation is also shown in FIG. 5.

The process flow as a whole is, therefore, that the intake-pipe pressure is calculated from the throttle-flap angle, the air mass sucked in is determined provisionally by means of the intake-pipe pressure, the provisional value is corrected by means of a temperature-dependent value, the fuel mass required for obtaining a predetermined lambda value is calculated from the corrected value, and this fuel mass is corrected by means of a wall-film model, in order to obtain the actual fuel mass to be injected for the stroke following the current stroke.

Figure 6:
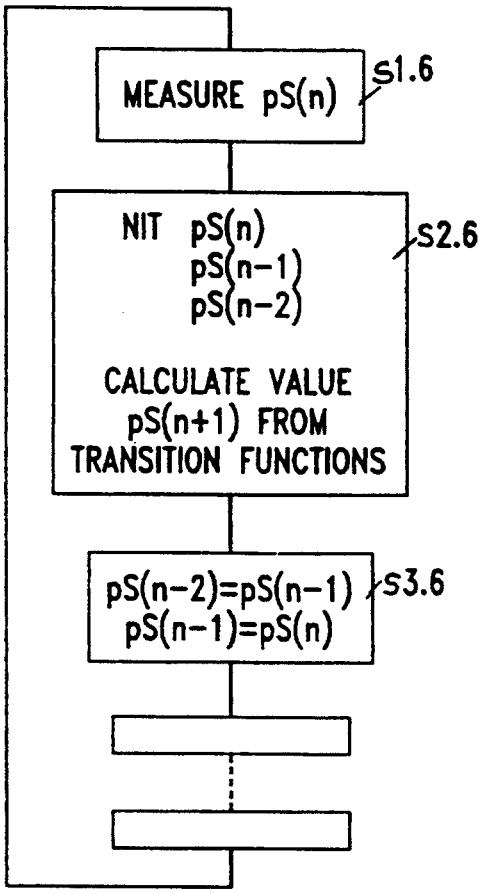
FIGS. 6–8 show representations of part process flows for determining the intake-pipe pressure probably prevailing during the next cycle, the part process flow being represented as a flow diagram in FIG. 6, but as a block diagram in FIGS. 7 and 8.
Figure 7:
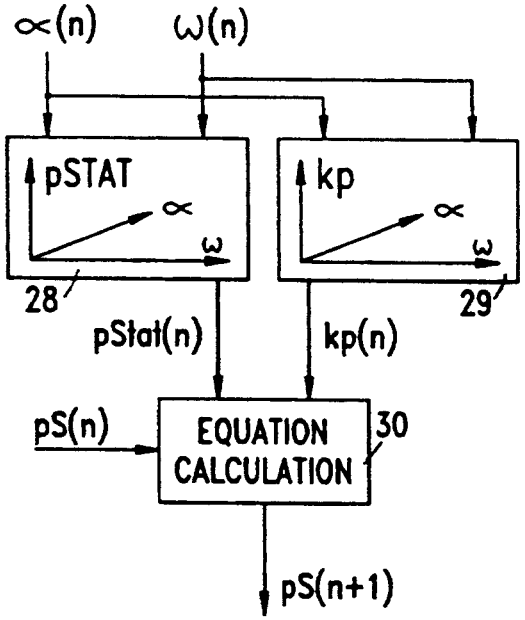
Figure 8:
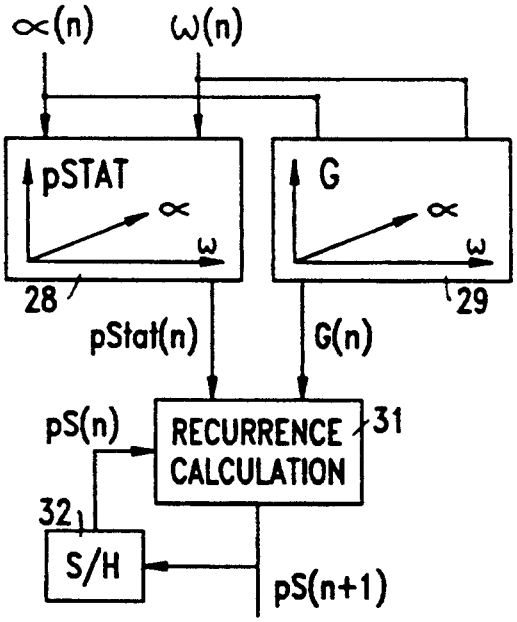

Exemplary embodiments of how the pressure calculation is advantageously carried out are now described by reference to FIGS. 6–8. The starting point for all three part processes explained with reference to FIGS. 6–8 is the transition function of the first order according to FIG. 2 and according to equation (1). A transition function of the first order most accurately describes the behavior observed on hitherto researched internal-combustion engines after a sudden change in the throttle-flap angle. The transition function of the first order according to equation (1) has three parameters, specifically the final pressure Pstat, the initial pressure $Ps(t_0)$ and the time constant kp. The process according to FIG. 6 is characterized in that all three parameters are determined by pressure measurements, whereas in the processes according to FIGS. 7 and 8 two parameters are determined from families of characteristics and the third parameter is obtained by a pressure measurement or the determination of the third parameter is avoided by means of a recurrence formula. The jump time to is reset to zero with each computing cycle, with the result that $Ps(t_0)=Ps(n)$.

In the part process according to the embodiment of the invention shown in FIG. 6, the pressure Ps(n) during the current computing cycle is measured in a step s1.6. From this newly-measured value and the two values Ps(n−1) and Ps(n−2) measured in the previous cycles, the three parameters of equation (1) are determined in a step s2.6, and then the intake-pipe pressure Ps(n+1) prevailing at the time of the cycle n+1 is calculated from equation (1). In a step s3.6, the pressure value of the last cycle is judged as the pressure value of the last cycle but one and the pressure value of the current cycle is judged as the pressure value of the preceding cycle, so that these two values are available as past values when, after the execution of further process steps for calculating the fuel quantity to be injected, the step s1.6 is reached again in the following cycle and the pressure then measured is the current pressure.

When the throttle-flap change takes place abruptly, as shown in FIG. 1, the pressure-calculation process described then supplies, for the next cycle, a pressure value which corresponds very closely to the value measured at that time, . In particular, the same transition equation then applies to all the measurement points. That is to say, the three parameters remain unchanged. However, if the throttle-flap angle changes between the measurement points, the parameters also change, so that different parameters apply at different times, but in step s2.6 it is assumed that the same transition function is always valid.

In contrast, throttle-flap changes which took place before the current cycle do not influence processes such as those now explained by reference to FIGS. 7 and 8. In the two processes, two of three parameters of equation (1) are read out from families of characteristics, namely the final pressure Pstat and the time constant kp, these values being dependent on the values of the throttle-flap angle $\alpha$ and speed which are present in the current cycle. Thus, the stationary pressure Pstat(n) is read out from a family of stationary-pressure characteristics 28 addressable as the values $\alpha(n)$ and $\omega(n)$. The value kp(n) of the time constant which is valid for these values is read out from a family of time-constant characteristics 29 addressable via the same values. The values of stationary pressure and time constant are transmitted to a means 30 for equation calculation, to which the current value Ps(n) of the intake-pipe pressure is also fed. The third parameter $t_0$ is calculated from equation (1) by means of this measured value. When this has taken place, the intake pressure Ps(n+1) probably occurring during the next cycle is calculated by means of equation (1). In this process, therefore, all three parameters are determined solely on the basis of currently available measured values. In non-stationary situations, the accuracy is thereby increased in comparison with the accuracy which can be achieved with the process explained by reference to FIG. 6. In the stationary mode, however, the process building up on pressure measurement values only is somewhat more accurate, since it does not: involve characteristic values.

An embodiment of the invention, now explained by reference to FIG. 8 makes do with very simple means. In particular, it needs no pressure measurement, but uses only the values of the throttle-flap angle $\alpha$ and speed $\omega$ which are available in any case on internal-combustion engines. The families of characteristics described by reference to FIG. 7 are addressed by means of these values. The process according to FIG. 8 differ (sic) from that according to FIG. 7 in that the intake-pipe pressure Ps(n) is not measured, but is determined from a recurrence formula in a means 31 for recurrence calculation. This is carried out according to the following equation:

$$Ps(n+1)=Ps(n)+G(\alpha(n)),\ \omega(n))\times(Pstat(n)-Ps(n)) \qquad (2)$$

The intake-pipe pressure Ps(n+1) for the next cycle, determined by this recurrence formula, is stored for the calculation in the next cycle, this being represented in FIG. 8 by a sensing/holding element 32. In the following cycle, the pressure Ps(n+1) for the next cycle, calculated in the way just described, is the current pressure value Ps(n). The factor G and the time constant kp, as it stands in equation (1), are mutually convertible. The process just described has the advantages and disadvantages of the process according to FIG. 7, but advantageously differs from this in that there is no need for a pressure sensor which is relatively expensive. In contrast, a disadvantage is that errors in calculation cf the intake-pipe pressure are propagated, since a value not calculated completely correctly for the next cycle is incorporated in the next calculation as a correctly assumed current value.

It was already pointed out further above, in the comparison between the processes according to FIGS. 6 and 7, that the process according to the embodiments of the invention shown in FIG. 7 and, FIG. 8 is very up-to-date, but that there is a slight disadvantage in that values have to be read out from families of characteristics in which slightly incorrect values can sometimes be filed for the present internal-combustion engine. This defect can be eliminated by means of an adaptation process. An exemplary embodiment of such a process is now described by reference to FIG. 9.

In the embodiment of the invention shown in a first step s1.9 of the adaptation process according to FIG. 9, the intake-pipe pressure Ps(n), such as occurs during the present cycle n, is measured. In a step s2.9, this measured value is compared with the pressure value calculated in the previous cycle for the next cycle. If the two values deviate from one another by more than a predetermined threshold value ΔPs, in a step s3.9 it is calculated which value the time constant G would have to possess so that the calculation in the previous cycle would have supplied the value measured in the present cycle. When this value is determined, the value filed for the associated values of throttle-flap angle and speed is corrected in the direction of the newly-calculated value. For the way in which such a correction can be carried out, attention is drawn to the publication DE 36 03137 A1, in which further literature on the adaptation process is also given.

After the step s3.9 or also when there is a negative answer to the question in step s2.9, a step s4.9 is reached. This investigates whether stationary operating conditions are present. If this is not so, the process returns to step s1.9. In contrast, if stationary operating conditions are present, the stationary pressure Pstat($\alpha$, $\omega$) is measured in a step s5.9. A step s6.9 investigates whether this measured value differs from the pressure value stored for the present values of the addressing variables $\alpha$ and $\omega$ by more than a predetermined threshold value ΔPstat. If this is so, the characteristic value is corrected in the direction of the measured value in a step s7.9. The above statement on the correction of the family of time-constant characteristics applies accordingly to the details of this. After the step s7.9 and also if there is a negative answer to the question in step s6.9, the process returns to step s1.9.

The processes according to the embodiments illustrated in FIGS. 6, 7 or 8 and 9 can also be carried out jointly. For example, all the processes are operated continuously in parallel. If no throttle-flap change has taken place before the last three measurements, the pressure values calculated by means of the process according to the embodiment FIG. 6 are used. In contrast, if such a change has taken place, the pressure values calculated by means of the process according to the embodiment shown in FIG. 7 or by means of the process according to the embodiment shown in FIG. 8 are used. The adaptation of the families of characteristics takes place continuously in the way described.

In the description of the state of the art, it was stated that systems in series are those in which the intake pressure is measured continuously and the injection time for the following intake stroke is calculated from the current intake-pressure value. The accuracy of the control-value determination in systems of this kind can be improved considerably if the intake-pipe pressure determined by the process according to the invention is used, that is to say not the currently measured intake-pipe pressure, but the pressure previously calculated for the next intake stroke of a particular cylinder.

A further improvement can be obtained if the calculated value is also corrected by means of a temperature-dependent air mass MLT, as mentioned briefly further above with reference to FIGS. 3 and 5. This measure can also be implemented without the above-described precalculation of the intake pressure, that is to say when currently measured intake-pipe pressure is used as the intake-pipe pressure prevailing during the next cycle.

The temperature-dependent correction is based on the fact that, when both the intake pipe and the engine are relatively cold, the masses flowing into the intake pipe and the engine are allocated differently from when the intake pipe is cold and the engine is hot. The air mass flowing into the engine for combustion therefore depends not only on the intake-pipe pressure, but also on temperature differences. It has emerged that the time behavior of such temperature influences can be simulated relatively closely by means of a transition function of the second order which has essentially only one parameter closely dependent on values of operating variables, namely a stationary temperature ΔTstat. Such stationary temperatures are filed in the family of auxiliary-temperature-variable characteristics 26 addressable via values of the throttle-flap angle, the speed and the engine temperature. That is to say, $\Delta Tstat(n)=f(\alpha(n), \omega(n), T_w(n))$. The recurrence formula reads as follows:

$$\Delta T(n+1)=k1(n)\times(\Delta Tstat(n)-\Delta T(n))+k2(n)\times(\Delta T(n)-\Delta T(n-1)) \quad (3)$$

The constant values k1(n) and k2(n) are also read out from the family of auxiliary-temperature-variable characteristics 26 in a corresponding way to the stationary temperature ΔTstat(n). By means of these variables, the above-mentioned recurrence formula (3) is evaluated in the means 27 for recurrence calculation.

The auxiliary variable ΔT used for correcting the provisionally calculated air mass MLV bears the dimension of a temperature merely for the sake of clarity, in order thereby to express the fact that the corrected influences are mainly temperature influences. The correcting variable could also be directly non-dimensional. Further effects in addition to temperature effects, especially vibration effects, can be taken into account by modifying the above-mentioned recurrence formula, for example by also multiplying by a trigonometric vibration function.

With the correction value being taken into account, the air mass to be provided with fuel is obtained as follows:

$$M1(n+1)=MLV(n+1)\times(1+Kt\times\Delta T(n+1))$$

An adaptation process can also be carried out in respect of the air mass M1. For this, the calculated air mass M1(n+1) is compared with the air mass actually sucked in during the cycle n+1. This measurement is made, for example, by means of an air-mass meter which detects the air-mass flow. The mass sucked in is obtained from the mass flow and the intake time. If the difference between the actual air mass sucked in and the calculated air mass exceeds a threshold value, the stationary temperature Tstat is preferably calculated in reverse, so that the corrected stationary temperature would have given the correct air mass. The corrected stationary temperature is then filed in the family of characteristics 26.

Starting from the calculated air mass M1(n+1), on the one hand the ignition time is set and on the other hand the fuel mass to be added to this air mass is calculated. The setting of the ignition time is carried out by selecting a conventional family of speed/air mass/ignition-time characteristics. It is advantageous if the selection of this conventional family of characteristics is no longer made by means of the currently measured air-mass value, but by means of the previously calculated value. The ignition time can also be calculated, not only from a family of characteristics, but from values of the speed and the air mass by means of an equation. In this case too, there is the advantage in that the calculation is carried out by means of the value for the expected air mass and not that for the current air mass.

The fuel mass is calculated from the air mass by means the predetermined desired lama value λSOLL(n+1) in the divider stage 27. The fuel mass obtained by division of the air mass M1(n+1) by the desired value is only a provisional fuel mass MKV(n+1). It is provisional because it is still necessary to take into account how much fuel is involved in the build-up of a wall film, when there is an increased feed of fuel, or how much fuel is obtained from the removal of the wall film, when there is a reduced fuel feed. The wall-film correction is made by means of any known process, preferably that described in "Transient A/F Control Characteristics of the 5 l Central Fuel Injection Engine by C. F. Aquino in SAE Paper 81 0494, pages 1-15". Accordingly, the time change of the wall-film fuel mass MKF is calculated from a fed fuel mass MKZ according to the following equation:

$$\frac{dmkf}{dt} = XMKZ - \frac{1}{r} \times MKF$$

with

X=precipitation rate r=evaporation time constant

From this results, as a transition fuel quantity Mk originating from the wall film or merging into this, the following equation $$r(1-X)\frac{dmk\ddot{U}}{dt}+Mk\ddot{U}=rX\frac{dmkv}{dt}$$

The actual fuel quantity to be injected Mk(n+1) is then calculated as:

$$Mk(n+1)=MKV(n+1)+Mk\tilde{U})(n+1)$$

It is pointed out that the above-mentioned transition functions and recurrence formulas for calculating the intake-pipe pressure or the temperature influence are only examples which have emerged as advantageous from previous measurements. In particular uses, other transition functions and associated recurrence formulas may also better describe the conditions actually measured. The critical factor is that two processes are given, each of these improving the known processes. The processes can each be used independently or jointly. One process involves previously calculating the particular intakepipe pressure prevailing for the next intake cycle, and the other process involves correcting the intake-pipe pressure, irrespective of how this has been determined, by means of a temperature-effect model.

It has been assumed hitherto, for the sake of simplicity, that a computing cycle takes place in each case for the intake stroke of each individual cylinder. That is to say, in a four-stroke engine, the calculation is repeated every 720° of the crank angle for each cylinder. However, since the intake strokes of a four-cylinder four-stroke engine are offset only at 180° relative to one another, this means that the calculation has to be carried out separately for all four cylinders and for each cylinder it is necessary to store the last respective calculated value which is involved in the calculation of the next respective value for this cylinder. For each cylinder, an adaptation to changed conditions, especially to a changed position of the throttle flap, takes place only every 720°. The easily understandable procedure therefore entails a number of disadvantages.

By reference to FIG. 10, a procedure avoiding the disadvantages just mentioned is now described. In FIG. 10, for four cylinders Z1–Z4, the respective intake strokes are plotted as rectangular boxes, each of the same length. That is to say they each have the same crank-angle overlap. The particular intake-pipe pressure in the middle of an intake stroke is to be calculated so that the fuel mass to be injected can be determined from this. The middles of all the intake strokes are respectively at a distance of 180° from one another. Marks M1–M4 relate to these middles. The mark M1 indicates the crank angle at which it is enquired what fuel mass is to be injected for the cylinder Z1, so that this fuel can be sucked in during its next intake cycle. In the situation illustrated, the mark M1 is located at the crank angle O and the middle of the associated intake stroke is at 540°. The calculation of the fuel mass is started in each case a few degrees of crank angle before one of the marks appears, so that the calculation result is available when the mark appears.

Starting from these preconditions, the evaluation of the recurrence formula (2) for the intake-pipe pressure is now described.

Since a calculation of the intake-pipe pressure is carried out every 180°, the constant values $G(\alpha(n), \omega(n))$ are filed for the respective time interval in which 180° crank angles are overlapped at the particular speed. When the recurrence formula (2) is calculated once, the intake-pipe pressure, such as will probably occur 180° later, that is to say before the mark M2 is set, is obtained. However, since the intake-pipe pressure at the mark M4 is of interest, the recurrence according to equation (2) is executed twice more. Shortly before the mark M1 appears, therefore, the evaluation of the recurrence formula (2) takes place three times in quick succession. Thus, the calculation result for the fuel quantity to be injected in the intake stroke of the cylinder Z1 occurring at the mark M4 is available when the mark M1 appears.

It is expedient to store the intermediate result for each individual recurrence calculation, specifically for the following reason. The calculation result of the first use of the recurrence forms the initial value, when the recurrence is executed three times again shortly before the appearance of the mark M2, in order to calculate the fuel mass which is required for the intake stroke of the cylinder Z2 around the next mark M1. If the recurrence formula is used once with this initial value, the result would have to correspond to that which was obtained after the second use of the recurrence formula shortly before the appearance of the mark M1. However, there is no correspondence if the position of the throttle flap has changed in the meantime. If there is no correspondence, this fact is preferably utilized to correct the fuel mass for the still forthcoming intake stroke of the cylinder Z1 around the mark M4. If more fuel is required than was first calculated, the differential quantity is injected additionally. If it emerges that less fuel would have been required than has already been injected, the differential value is subtracted during the next injection for the cylinder Z1. If only a small advance is adopted in the operating state prevailing at the present time, that is to say if, when the mark M2 appears, the fuel for the intake stroke of the cylinder Z1 around the mark M4 has not yet been injected, the fuel quantity required is recalculated.

It is also possible, with each recurrence step, to cover not 180°, but a smaller angular sector, for example only 60. A computing mark is then output every 60° crank angle. At those computing marks which are not located just in front of one of the marks M1–M4, the recurrence formula (2) is used only once. In contrast, in the calculation executed shortly before one of the marks M1–M4, the recurrence equation is executed nine times in succession, in order to predict the intake-pipe pressure for a time when the crank angle has covered a further 540°. The smaller the angular sector covered by a recurrence evaluation, the more up-to-date is the adaptation to possible changes of the throttle-flap angle, but the higher is the computation outlay.

The prediction does not necessarily have to take place over an angular sector of 540. This sector was chosen in the particular example, since it also covers the longest advance times. If the process is used on an engine having a shorter maximum advance time, the future calculation covers a correspondingly smaller angular sector.

What was explained above as regards the evaluation of equation (2) applies accordingly to the evaluation of equation (3) for the auxiliary temperature variable $\Delta T$.

We claim:

1. A process for determining a fuel quantity to be fed into an internal combustion engine during each intake stroke, comprising the steps of:

(a) determining an air intake cross-section and an angular velocity of a crank shaft for a current stroke;

(b) determining a current intake-pipe pressure associated with predetermined operating conditions based on the air intake cross-section and angular velocity;

(c) determining a time constant for a change in the intake-pipe pressure based on the air intake cross-section and the angular velocity of the crank shaft;

(d) determining a projected intake-pipe pressure for a next stroke based on the current intake-pipe pressure associated with predetermined operating conditions, and the time constant for the change in intake-pipe pressure;

(e) determining an air mass sucked into the air intake for an intake stroke based upon the projected intake pipe pressure for the next stroke; and (f) determining the fuel quantity to be fed to each cylinder for the next stroke based on the air mass determinations made in step (e) and a wall film model.

2. A process according to claim 1, wherein the intake-pipe pressure for the current stroke is determined by measurement.

3. A process according to claim 1, wherein the projected intake-pipe pressure for the next stroke is determined according to a recurrence formula in which the intake-pipe pressure projected in a previous fuel feed determining cycle is used as a value for the current intake-pipe pressure.

4. A process according to claim 1, wherein a predetermined value for the intake-pipe pressure associated with predetermined operating conditions is determined from a family of characteristics addressable via current values of the air intake cross-section and the angular velocity of the crank shaft.

5. A process according to claim 4 wherein the process further includes the steps off:

(a) measuring the intake-pipe pressure under predetermined operating conditions; and (b) comparing a characteristic value associated with present operating conditions to the measured value and, when the difference between the characteristic value and the measured value exceeds a threshold level, correcting the characteristic value in a direction of the measured value.

6. A process according to claim 1, wherein a predetermined value for the time constant is determined from a family of characteristics addressable via the current values of the air intake cross-section and the angular velocity of the crank shaft.

7. A process according to claim 6, wherein the process further includes the steps of:

(a) comparing a current measured intake-pipe pressure to the projected intake-pipe pressure for that stroke and, when the difference between the values exceeds a threshold level, recalculating the time constant so that the projected value corresponds to the measured value; and (b) correcting the value of the time constant in the direction of the newly calculated time constant value.

8. A process for determining a fuel quantity to be fed into an internal combustion engine during each intake stroke, comprising the steps of:

a. measuring a present intake pipe pressure, for a present intake stroke, for each cylinder;

b. predicting, during a period when there is no change in an air intake cross-section for each cylinder, a subsequent intake pipe pressure, for a subsequent intake stroke, for each cylinder based upon at least the present intake pipe pressure for each cylinder;

c. determining, for each cylinder, an air mass sucked therein for the subsequent intake stroke based upon the predicted subsequent intake pipe pressure for each cylinder; and d. determining a fuel quantity to be fed to each cylinder during the subsequent intake stroke based upon the air mass determinations of step c.

9. The process according to claim 8 wherein, after a change in the air intake cross-section, a predicted subsequent intake pipe pressure is based only upon the present intake pipe pressure.

10. The process according to claim 8 further comprising the step of determining an ignition time for each intake stroke based upon the air mass determinations of step c.

11. A process for determining a fuel quantity to be fed into an internal combustion engine during each intake stroke, comprising the steps of:

a. measuring a present intake pipe pressure, for a present intake stroke, for each cylinder;

b. predicting, during a period when there is no change in an air intake cross-section for each cylinder, a subsequent intake pipe pressure, for a subsequent intake stroke, for each cylinder based upon at least the present intake pipe pressure for each cylinder;

c. determining, for each cylinder, a subsequent air mass sucked therein for the subsequent intake stroke based upon the predicted subsequent intake pipe pressure for each cylinder;

d. determining a temperature of a present air mass sucked into each cylinder;

e. determining an air mass correction value based upon the temperature of the present air mass;

f. correcting, for each cylinder, the subsequent air mass determined in step c based upon the air mass correction value; and d. determining a fuel quantity to be fed to each cylinder during the subsequent intake stroke based upon the corrected subsequent air mass determinations of step f and a wall film model.

12. The process according to claim 11, further comprising the step of determining an ignition time for each stroke based upon the corrected subsequent air mass determined in step f.

* * * * *